United States Patent [19]

Elenbaas

[11] 4,144,431

[45] Mar. 13, 1979

[54] MEANS OF SECURING MECURY DISPLACEMENT SWITCHES TO A MOUNTING BRACKET

[76] Inventor: George H. Elenbaas, P.O. Box K, Edwardsburg, Mich. 49112

[21] Appl. No.: 798,361

[22] Filed: May 19, 1977

[51] Int. Cl.[2] ..... H01H 29/04

[52] U.S. Cl. ..... 200/295; 200/188; 200/307; 335/162

[58] Field of Search ..... 200/5 R, 182, 187, 188, 200/295, 307; 335/162; 248/248

[56] References Cited

U.S. PATENT DOCUMENTS

| | | | |
|---|---|---|---|
| 2,046,272 | 6/1936 | Larson et al. | 335/162 X |
| 2,142,151 | 1/1939 | Sambleson | 200/188 |
| 2,534,354 | 12/1950 | Keller | 335/162 X |
| 2,776,351 | 1/1957 | Mitchell | 200/307 X |
| 2,881,284 | 4/1959 | Mekelburg | 335/162 X |
| 3,174,009 | 3/1965 | Deeg | 335/162 X |

*Primary Examiner*—Stephen Marcus

*Attorney, Agent, or Firm*—Oltsch, Knoblock & Hall

[57] ABSTRACT

One or more mercury displacement switches are positioned against a plate-shaped mounting bracket and interlocked to the plate by means of a strap extending around each switch and through the mounting bracket.

5 Claims, 12 Drawing Figures

Fig. 3
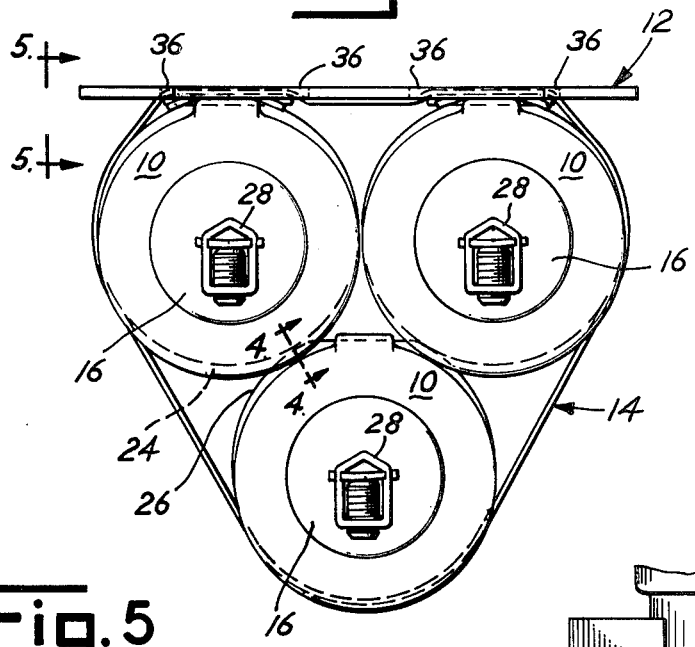
Fig. 4
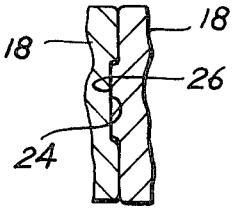
Fig. 5
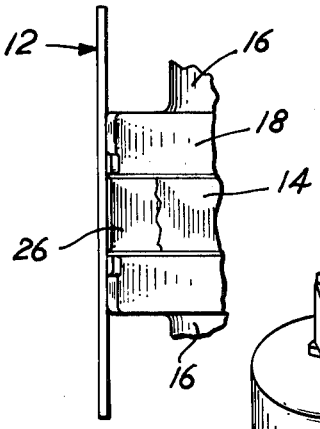
Fig. 6
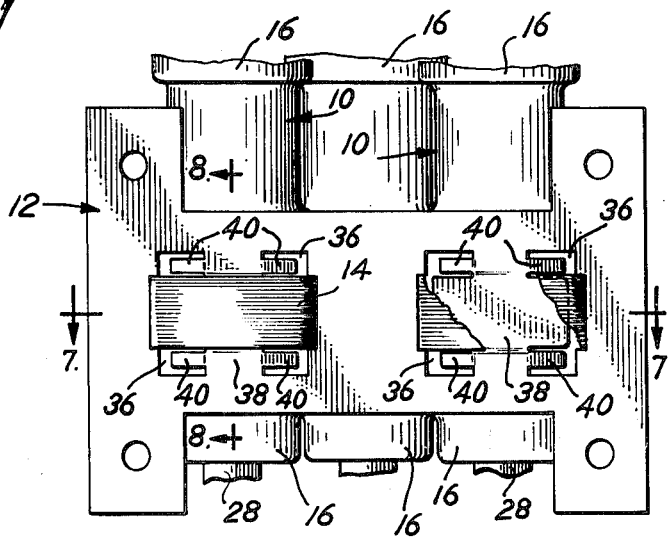
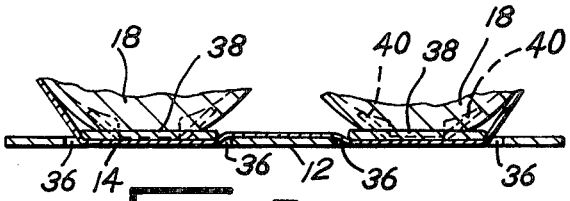
Fig. 7
Fig. 9
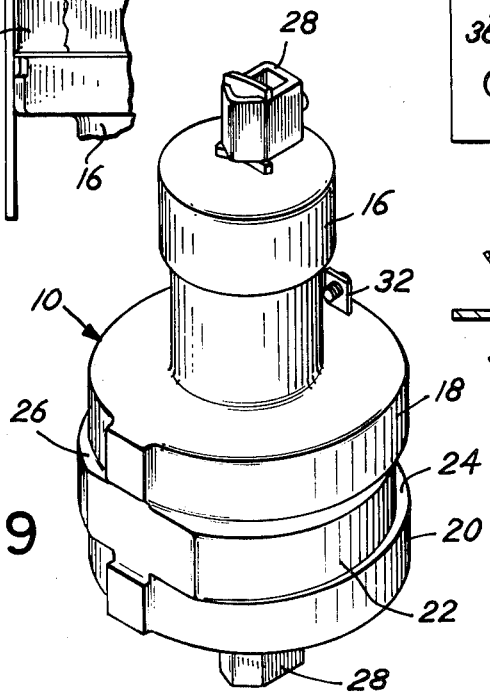
Fig. 8
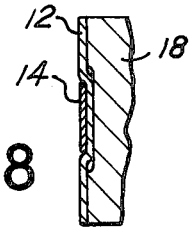

MEANS OF SECURING MECURY DISPLACEMENT SWITCHES TO A MOUNTING BRACKET

SUMMARY OF THE INVENTION

This invention relates to the mounting of one or more mercury displacement switches or relays to a mounting bracket and will have specific but not limited application to a means for nesting a plurality of such switches for connection to the mounting bracket.

In the combination of this invention each mercury displacement switch includes a case having first and second neck parts and an enlarged body part located between the neck parts and having a generally cylindrical outer surface. Each neck part terminates in a load contact for connection to a power circuit. The body part surface of each switch includes an eccentric offset center portion which forms a groove in the outer surface of the switch extending about approximately one-half of the circumference of the surface and a raised land which extends about the remaining approximate one-half of the circumference of the surface of the body part. The bracket is preferably of a plate form and has at least one pair of parallel slots formed in it which define a rib section between the slots. Spaced protrusions forming a part of each bracket are carried by each rib section with the spacing between the protrusions exceeding the width of each switch land. The combination of a mounting bracket and one or more switches is assembled by having the land of a switch fitted between each set of spaced bracket protrusions and each remaining switch seated against such bracket fitting switches with its land fitting into the body part grooves of the other switches. A strap encircles the one or more assembled switches and extends through the slots in the mounting plate to secure each switch to the mounting plate.

Accordingly, it is an object of this invention to provide an effective, economical means of securing one or more mecury displacement switches to a mounting bracket to create a single or multiple pole switching mechanism.

Another object of this invention is to provide a mercury displacement switch having a unique body construction which enables it to be interlocked with other similar type switches on a mounting plate.

Other objects of this invention will become apparent upon a reading of the invention's following description.

BRIEF DESCRIPTION OF THE DRAWINGS

FIG. 3 is a top plan view of the three pole switching mechanism.

FIG. 4 is a fragmentary sectional view taken along line 4—4 of FIG. 3.

FIG. 5 is a fragmentary side view as seen from line 5—5 of FIG. 3.

FIG. 6 is a rear view of the three pole switching mechanism.

FIG. 7 is a fragmentary cross sectional view taken along line 7—7 of FIG. 6.

FIG. 8 is a fragmentary sectional view taken along line 8—8 of FIG. 6.

FIG. 9 is a perspective view of a switch component as seen partially from the rear.

DESCRIPTION OF THE PREFERRED EMBODIMENTS

Figure 1:
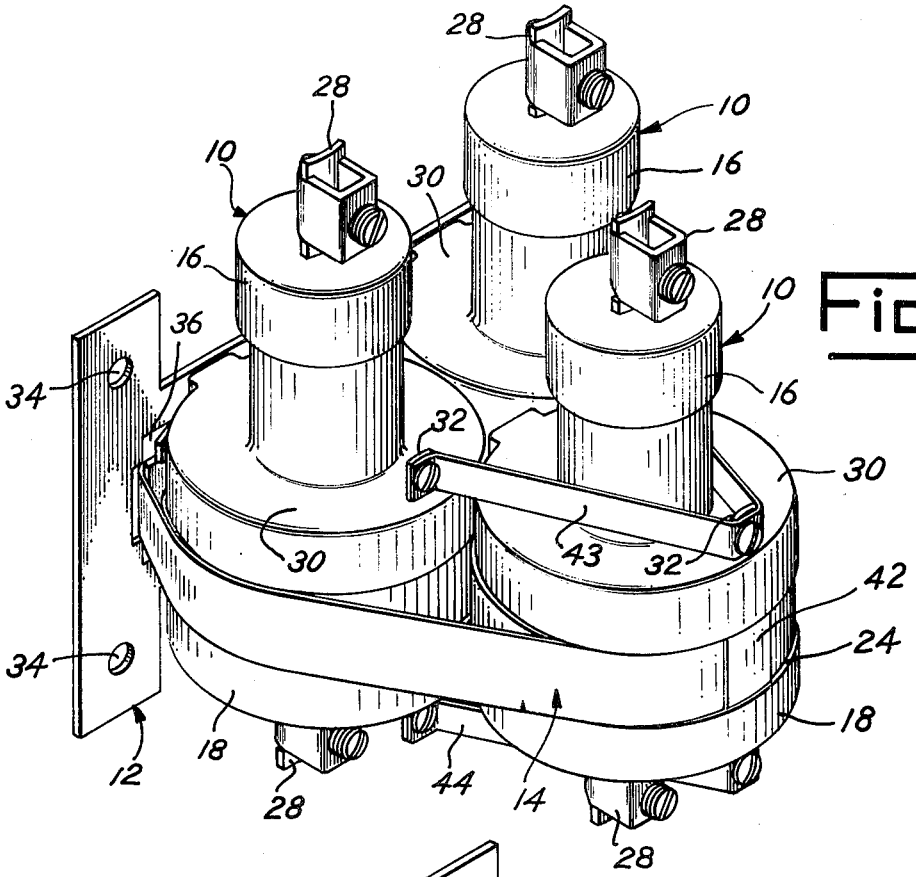
FIG. 1 is a perspective view of a three pole switching mechanism.
Figure 2:
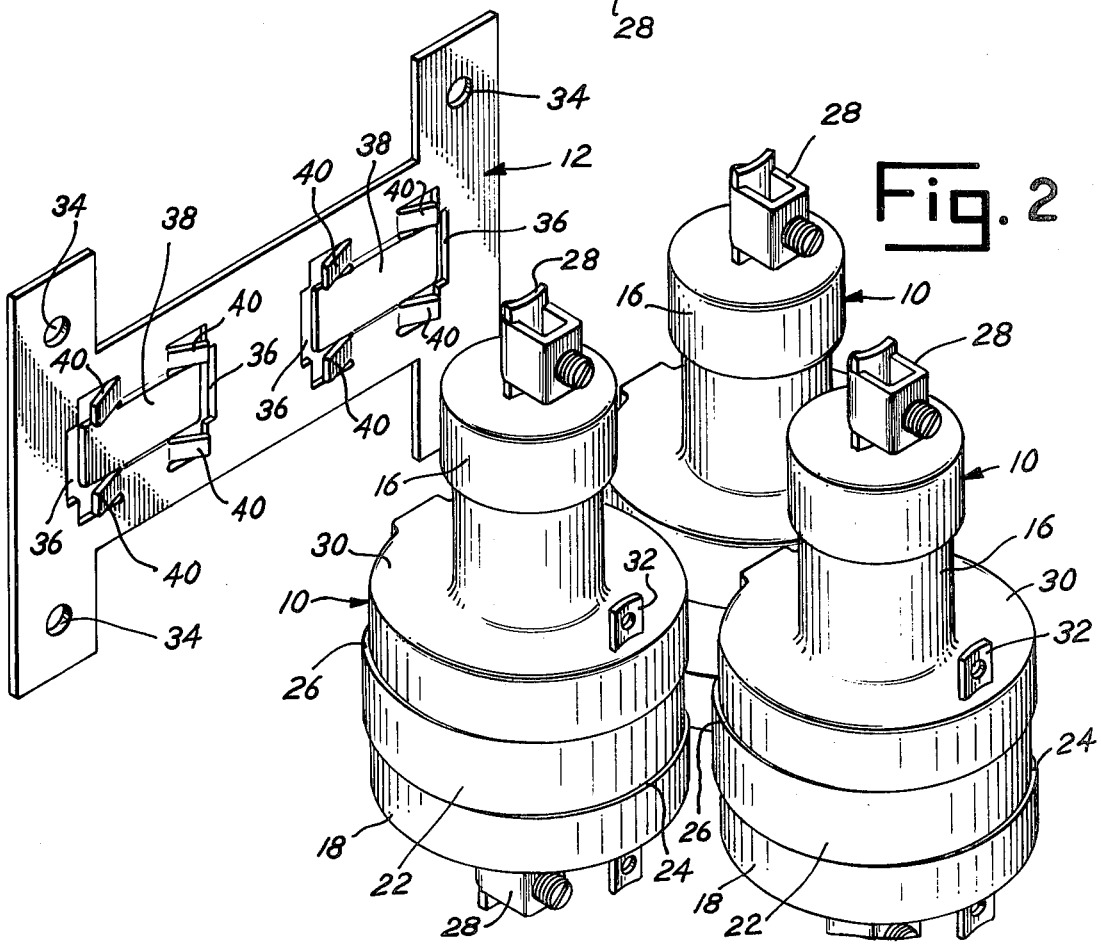
FIG. 2 is a view of the three pole switching mechanism shown with its bracket and switch components in separated form.

The preferred embodiments illustrated are not intended to be exhaustive or to limit the invention to the precise forms disclosed. They are chosen and described in order to best explain the principles of the invention and its application and practical use to thereby enable others skilled in the art to best utilize the invention.

The combination of this invention includes one or more mercury displacement switches 10 connected to a mounting bracket 12 by a strap 14. Each switch 10 is of similar construction and includes coaxial neck parts 16 and an enlarged body part 18 which is located between neck parts 16. Body part 18 has a cylindrical outer surface 20 interrupted by an eccentric offset central section 22. The offset of central section 22 creates a groove 24 which extends about one-half the circumference of body part 18 and a raised land 26 which extends about the remaining one-half of the circumference of the body part. Each switch neck part 16 terminates in a load contact 28. Protruding from each end face 30 of switch body part 18 is a coil terminal 32. The internal construction and operation of each mercury displacement switch 10 is well known in the art, with load contacts 28 being adapted for connection into a power circuit and with coil terminals 32 serving to receive the actuating current for the switch.

In FIG. 1 three mercury displacement switches 10 are shown connected to bracket 12. Bracket 12 is of a plate shaped form and may be of a metallic composition. Holes 34 in bracket 12 are provided to accommodate screws or nails utilized for attaching the bracket and its switches 10 to a mounting surface in a vertical orientation. Two pairs of parallel slots 36 are formed in bracket 12. Between each pair of slots is a rib section 38. Extending from each rib section 38 are four outwardly turned tabs 40. Tabs 40 are paired with each pair being located at opposite ends of each rib section 38. The spacing between pairs of tabs 40 is just slightly greater than the width across land 26 of each switch 10.

The switch mechanism illustrated in FIGS. 1–8 is of a three pole type in which two of the switches are mounted upon brackets 12, each having its land 26 fitted between a pair of tabs 40 of the bracket which serves to anchor the switch against longitudinal displacement relative to the bracket. The third switch 10 is then seated against the two bracket contacting switches 10 with its land 26 fitted within the grooves 24 of the other switches. In this manner the third or outermost switch 10 is prevented from longitudinal displacement relative to the bracket and the other two switches 10. Strap 14 which may be of a flexible plastic composition extends about the three switches 10 by fitting within groove 24 of the outermost switch and passing through slots 36 in the bracket. A suitable connector 42 serves to connect the ends of strap 14 in constrictive form about the three switches 10 and bracket 12. Those coil terminals 32 at corresponding body part ends 30 of switches 10 are connected in parallel by a connector 43 and the coil terminals 32 at the other corresponding body part ends of the switches are connected in parallel by a connector 44.

Figure 10:
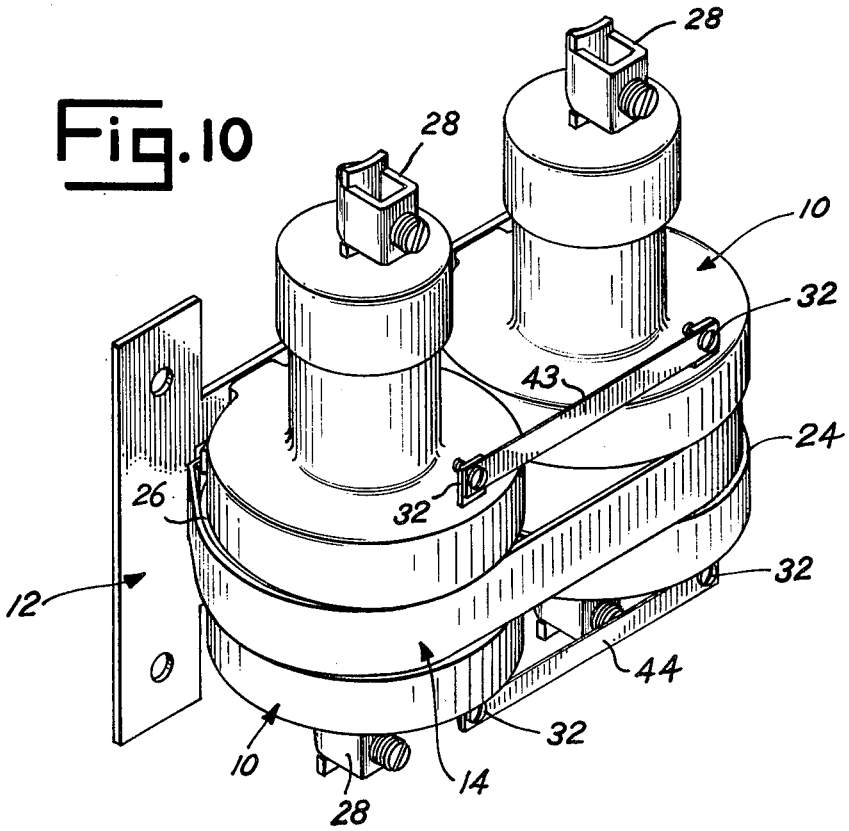
FIG. 10 is a perspective view of a two pole switching mechanism.

In FIG. 10 two switches 10 are secured to bracket 12 with their lands 26 fitting between pairs of tabs 40. A strap 14 extends about the two switches 10 within their grooves 24 and through slots 36 in the bracket to secure the switches to the bracket. This type of switch mechanism is of the two pole variety with corresponding coil terminals 32 being joined by connectors 43 and 44.

Figure 12:
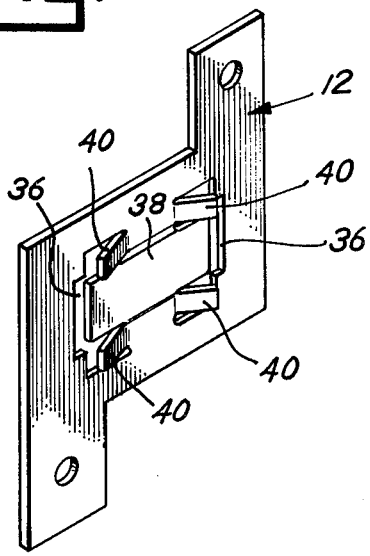
FIG. 12 is a perspective view of the bracket for the single pole mechanism.
Figure 11:
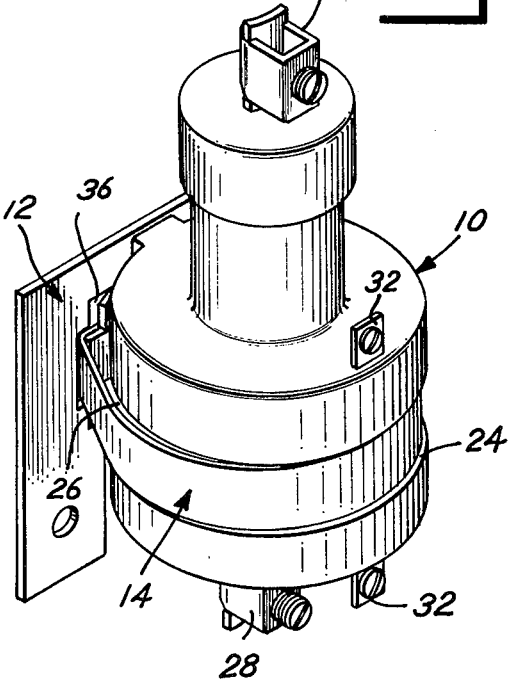
FIG. 11 is a perspective view of a single pole switching mechanism.

In FIG. 11 a single switch 10 is shown connected to a bracket 12. Bracket 12 of this embodiment, shown singly in FIG. 12, includes but a single pair of parallel slots 36 which form a rib section 38 therebetween. The land 26 of a switch 10 is fitted between pairs of tabs 40 extending from rib section 38 of this type bracket 12 and a strap 14 extends about the switch within its groove 24 and through slots 36 to secure the switch to the bracket. This type of switching mechanism is known as a single pole mechanism.

In each of the three above described embodiments of the combination mercury displacement switch and bracket of this invention the land and groove components of each switch 10 is utilized to lockingly cooperate with other switches 10 or a bracket 12 to anchor the switches against longitudinal movement relative to the bracket. The strap 14 passes about each switch and is utilized to secure each switch to its bracket. This form of "nesting" of multiple switches 10 may be utilized not only for three pole switch mechanisms but other multiple switch 10 combinations, such as six such switches in which three switches 10 would be mounted to a bracket 12 having therein three pairs of slots 36. The remaining three switches 10 would be interlocked by having the lands of two of the switches fitted into the grooves of the three bracket contacting switches and the remaining switch 10 having its land fitted within the grooves of the intermediate positioned switches, thus forming a pyramidal type nesting for the switches, all of which would be secured to the bracket by means of an encircling strap 14.

It is to be understood that the invention is not to be limited to the details above given, but may be modified within the scope of the appended claims.

What I claim is:

1. In combination a mercury displacement switch and mounting bracket, said combination wherein said mercury displacement switch includes first and second neck parts and an enlarged body part located between said neck parts, each neck part terminating in a load contact for connection to a power circuit, said switch body part having a generally cylindrical outer surface, said body part surface having an eccentric offset center portion forming a groove in said surface extending about approximately one-half of the circumference of the body part and a raised land extending about the other remaining approximate one-half of the circumference of the body part, said bracket including spaced protrusions, the spacing between said protrusions exceeding the width of said switch land, said switch fitted upon said bracket with the land thereof seating between said protrusions, and strap means for securing said switch to said bracket, said strap means extending about said switch body part within said groove therein and contacting said bracket.

2. The combination of claim 1 wherein said bracket has parallel slots formed therein defining a rib section between said slots, said spaced protrusions extending from said rib section, said strap means extending through said slots and around said rib section.

3. The combination of at least three mercury displacement switches and a mounting bracket, said combination wherein each mercury displacement switch includes first and second neck parts and an enlarged body part located between neck parts, each neck part terminating in a load contact for connection to a power circuit, each switch body part having a generally cylindrical outer surface, each switch including first and second coil terminals for connection to a switch actuating circuit, each body part surface having an eccentric offset center portion forming a groove in the surface extending about approximately one-half of the circumference of the body part and a raised land extending about the other remaining approximate one-half of the circumference of the body part, said bracket including two aligned pairs of spaced protrusions, the spacing between protrusions of each protrusion pair exceeding the width of each switch land, two of said switches positioned side by side and each fitted upon said bracket with the land thereof seating between a pair of protrusions, a third said switch paralleling said two switches and having its land fitting within the switch grooves of said two switches, and strap means extending about said third switch within its said groove and around said two switches and contacting said bracket.

4. The combination of claim 3 wherein said bracket has at least two parallel laterally aligned pairs of parallel slots formed therein, each pair of slots defining a rib section therebetween, a said protrusion pair extending from each rib section, said strap means extending through each of said slots and around said rib sections.

5. The combination of claim 3 wherein the first coil terminals of said switches are connected in parallel and the second coil terminals of said switches are connected in parallel.

* * * * *